US010711605B2

(12) United States Patent
Rowe

(10) Patent No.: US 10,711,605 B2
(45) Date of Patent: Jul. 14, 2020

(54) ISOTOPIC ANALYSIS FROM A CONTROLLED EXTRACTOR IN COMMUNICATION TO A FLUID SYSTEM ON A DRILLING RIG

(71) Applicant: Halliburton Energy Services, Inc., Houston, TX (US)

(72) Inventor: Mathew D. Rowe, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 201 days.

(21) Appl. No.: 15/123,194

(22) PCT Filed: Apr. 4, 2014

(86) PCT No.: PCT/US2014/032999
§ 371 (c)(1),
(2) Date: Sep. 1, 2016

(87) PCT Pub. No.: WO2015/152943
PCT Pub. Date: Oct. 8, 2015

(65) Prior Publication Data

US 2017/0074094 A1 Mar. 16, 2017

(51) Int. Cl.
*E21B 49/00* (2006.01)
*E21B 43/38* (2006.01)
*E21B 49/08* (2006.01)

(52) U.S. Cl.
CPC ..... *E21B 49/005* (2013.01); *E21B 43/38* (2013.01); *E21B 49/08* (2013.01); *E21B 2049/085* (2013.01)

(58) Field of Classification Search
CPC ... E21B 2049/085; E21B 49/005; E21B 49/08
See application file for complete search history.

(56) References Cited

U.S. PATENT DOCUMENTS 2,878,889 A * 3/1959 Gilbert ..... F02M 55/007 96/174
3,033,287 A 5/1962 Bond
3,633,687 A * 1/1972 West ..... E21B 21/067 175/48
3,922,871 A * 12/1975 Bolesta ..... F25B 9/04 62/5

(Continued)

OTHER PUBLICATIONS

Ellis et al. "Mud gas isotope logging (MGIL) assists in oil and gas drilling operations," Oil & Gas Journal, May 25, 2003.*

(Continued)

*Primary Examiner* — John Fitzgerald
(74) *Attorney, Agent, or Firm* — Jason Sedano; Baker Botts L.L.P.

(57) ABSTRACT

A method for downhole formation evaluation includes extracting a fluid sample from a drilling fluid using a controlled gas separator. The evaluation further includes extracting a plurality of individual chemical species from the fluid sample, wherein the individual chemical species include methane, ethane, propane, and CO2 and identifying isotope concentrations in each of the individual chemical species. Identified isotope concentrations in each of the individual chemical species are output for a first time period.

14 Claims, 4 Drawing Sheets

(56) References Cited

U.S. PATENT DOCUMENTS 4,010,012 A * 3/1977 Griffin, III ..... B01D 19/00 96/159
4,147,500 A * 4/1979 Karlsoen ..... G01N 33/0029 73/863.12
4,163,382 A * 8/1979 Amer ..... G01N 21/1702 250/351
4,257,794 A * 3/1981 Shirokov ..... F25J 3/0252 62/620
4,294,593 A * 10/1981 Rehm ..... B01D 19/0057 96/160
4,492,862 A * 1/1985 Grynberg ..... G01N 21/1702 250/255
4,510,801 A * 4/1985 Quigley ..... E21B 21/06 374/45
4,635,735 A 1/1987 Crownover
4,645,522 A * 2/1987 Dobrotwir ..... B01D 3/06 62/619
4,802,143 A * 1/1989 Smith ..... E21B 21/08 175/40
4,833,915 A 5/1989 Radd et al.
4,887,464 A * 12/1989 Tannenbaum ..... E21B 49/005 73/152.04
5,388,456 A 2/1995 Kettel
5,426,137 A * 6/1995 Allen ..... B01F 3/1271 366/158.4
6,148,658 A * 11/2000 Chou ..... G01N 21/1702 250/339.13
6,196,004 B1 * 3/2001 Lewis ..... B01D 5/0054 62/5
6,670,605 B1 12/2003 Storm, Jr. et al.
6,779,606 B1 * 8/2004 Lopez ..... E21B 21/06 166/303
6,888,127 B2 5/2005 Jones et al.
6,967,322 B2 * 11/2005 Jones ..... G01N 21/31 250/269.1
7,124,030 B2 10/2006 Ellis
7,174,254 B2 2/2007 Ellis
7,392,138 B2 * 6/2008 Frechin ..... E21B 49/005 702/9
7,529,626 B1 5/2009 Ellis
7,752,906 B2 * 7/2010 Pop ..... E21B 49/081 73/152.04
8,132,452 B1 * 3/2012 Selman ..... E21B 21/067 166/250.01
8,773,948 B2 * 7/2014 Johnson ..... G01V 1/44 367/31
8,801,837 B2 * 8/2014 Schexnaider ..... B01D 19/0057 95/242
8,810,794 B2 * 8/2014 Breviere ..... G01N 1/2294 356/432
9,671,381 B2 * 6/2017 Karoum ..... B01D 53/22
10,012,761 B2 * 7/2018 Jones ..... G01V 99/00
2002/0112888 A1 * 8/2002 Leuchtenberg ..... E21B 21/08 175/48
2003/0079912 A1 * 5/2003 Leuchtenberg ..... E21B 21/08 175/38
2003/0160164 A1 8/2003 Jones et al.
2004/0014223 A1 * 1/2004 Audibert ..... G01N 33/2823 436/30
2004/0164237 A1 * 8/2004 Jones ..... G01N 21/31 250/269.1
2005/0007583 A1 * 1/2005 DiFoggio ..... G01V 8/02 356/301
2005/0099618 A1 * 5/2005 DiFoggio ..... E21B 47/06 356/70
2006/0249288 A1 11/2006 Drozd et al.
2009/0050369 A1 * 2/2009 Pop ..... E21B 49/005 175/42
2009/0199618 A1 * 8/2009 Evrard ..... B01D 19/0063 73/19.09
2010/0031732 A1 * 2/2010 Breviere ..... G01N 1/2294 73/23.37
2010/0185395 A1 * 7/2010 Pirovolou ..... E21B 7/04 702/9
2010/0242572 A1 * 9/2010 Yu ..... G01N 21/1702 73/24.02
2010/0326655 A1 * 12/2010 Jones ..... C10G 33/00 166/267
2011/0094736 A1 * 4/2011 Evrard ..... E21B 21/067 166/267
2011/0139464 A1 * 6/2011 Henderson ..... E21B 21/01 166/370
2011/0290562 A1 * 12/2011 Standifird ..... E21B 21/08 175/57
2011/0301866 A1 12/2011 Holba et al.
2012/0138364 A1 * 6/2012 Leonard ..... G01N 27/026 175/50
2012/0150451 A1 * 6/2012 Skinner ..... G01N 33/2823 702/24
2012/0186450 A1 * 7/2012 Schexnaider ..... B01D 19/0057 95/261
2012/0186873 A1 * 7/2012 Shayegi ..... E21B 21/08 175/25
2012/0229287 A1 * 9/2012 Schuetzle ..... G01N 21/3504 340/632
2012/0241217 A1 * 9/2012 Davis ..... E21B 44/00 175/26
2013/0020128 A1 * 1/2013 Calleri ..... E21B 21/063 175/17
2013/0064715 A1 3/2013 Calleri
2013/0076907 A1 * 3/2013 Hobbs ..... E21B 47/12 348/158
2013/0192357 A1 * 8/2013 Ramshaw ..... E21B 44/00 73/152.03
2013/0197809 A1 * 8/2013 Jones ..... G01V 99/00 702/11
2013/0233057 A1 * 9/2013 Karoum ..... B01D 53/22 73/31.07
2013/0270006 A1 * 10/2013 Selman ..... E21B 49/005 175/24
2013/0275047 A1 * 10/2013 Selman ..... G01V 9/00 702/9
2013/0319104 A1 * 12/2013 Schexnaider ..... E21B 49/005 73/152.42
2014/0202664 A1 * 7/2014 Schexnaider ..... F28F 21/083 165/104.19
2014/0216176 A1 * 8/2014 Kimour ..... B01D 19/00 73/863.23
2014/0238670 A1 * 8/2014 Pop ..... E21B 7/04 166/264
2014/0298899 A1 * 10/2014 Schexnaider ..... E21B 49/08 73/152.23
2015/0240633 A1 * 8/2015 Akkurt ..... E21B 49/088 175/50
2016/0032720 A1 * 2/2016 Schexnaider ..... F04B 39/16 95/258
2016/0084023 A1 * 3/2016 Calleri ..... E21B 49/005 175/40
2016/0115786 A1 * 4/2016 Breviere ..... E21B 49/005 73/152.23
2016/0153955 A1 * 6/2016 Strapoc ..... G01N 33/0047 175/40
2016/0177711 A1 * 6/2016 Calleri ..... E21B 49/005 73/152.04
2016/0222781 A1 * 8/2016 Lawson ..... E21B 49/08
2016/0290131 A1 * 10/2016 Mitchell ..... E21B 47/102

OTHER PUBLICATIONS

International Search Report and Written Opinion issued in related PCT Application No. PCT/US2014/032999 dated Dec. 18, 2014, 14 pages.

Schlumberger Isotope Logging from http://www.slb.com/~/media/Files/geoservices/product_sheets/isotope_logging_ps.pdf, 2 pages, 2015.

(56) References Cited

OTHER PUBLICATIONS

International Preliminary Report on Patentability issued in related Application No. PCT/US2014/032999, dated Oct. 13, 2016 (11 pages).

* cited by examiner

ISOTOPIC ANALYSIS FROM A CONTROLLED EXTRACTOR IN COMMUNICATION TO A FLUID SYSTEM ON A DRILLING RIG

CROSS-REFERENCE TO RELATED APPLICATIONS

The present application is a U.S. National Stage Application of International Application No. PCT/US2014/032999 filed Apr. 4, 2014, which is incorporated herein by reference in its entirety for all purposes.

FIELD OF INVENTION

The present disclosure relates generally to downhole drilling operations and, more particularly, to a method and systems for producing consistently a sample fluid stream to characterize isotopic composition.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

Figure 1:
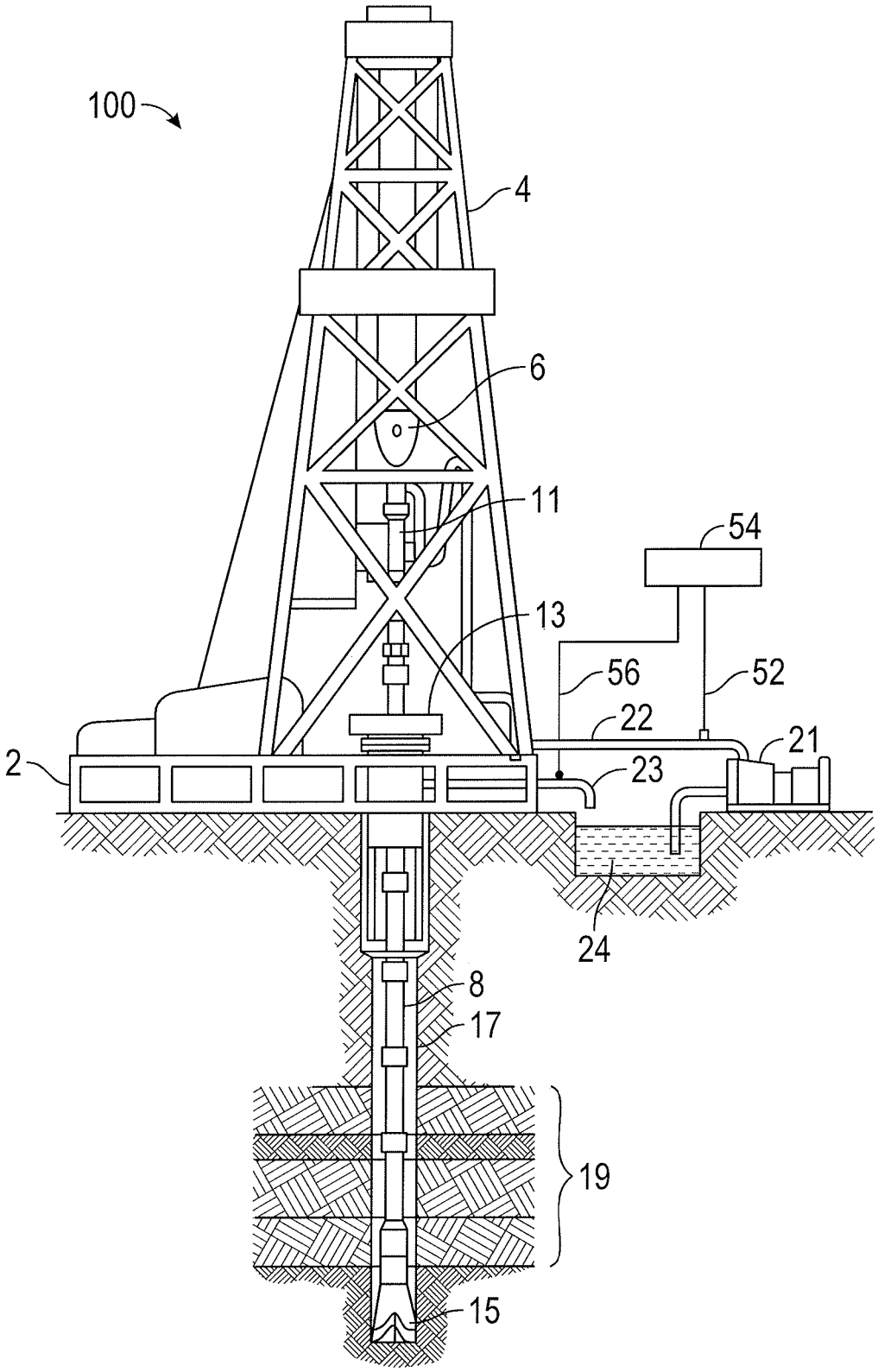
FIG. 1 is a diagram of an example drilling rig where the disclosed fluid sampling and characterization system and method are used.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to downhole drilling operations and, more particularly, to a method and systems for producing consistently a sample fluid stream to characterize isotopic composition.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

FIG. 1 illustrates a drilling rig system 100 which may be utilized in conjunction with an illustrative embodiment of the present disclosure. A drilling platform 2 is shown equipped with a derrick 4 that supports a hoist 6 for raising and lowering a drill string 8. Hoist 6 suspends a top drive 11 suitable for rotating drill string 8 and lowering it through well head 13. Connected to the lower end of drill string 8 is a drill bit 15. As drill bit 15 rotates, it creates a borehole 17 that passes through various formations 19. A drilling fluid circulation system includes a pump 21 for circulating drilling fluid through a supply pipe 22 to top drive 11, down through the interior of drill string 8, through orifices in drill bit 15, back to the surface via the annulus around drill string 8, and into a retention pit 24 via return pipe 23. The drilling fluid transports cuttings from the borehole into pit 24 and aids in maintaining the integrity of wellbore 16. Various materials can be used for drilling fluid, including, but not limited to, a salt-water based conductive mud.

A fluid extraction and analysis system 54 is fluidly coupled to the drilling circulation system via conduit 56 to extract an effluent gas sample from the drilling fluid existing borehole 17 via return pipe 23. Extractor 54 is also fluidly coupled to supply pipe 22 via conduit 52 to thereby extract an influent gas sample from drilling fluid entering borehole 17. Extractor 54 may be any variety of such devices, as understood in the art.

Figure 2:
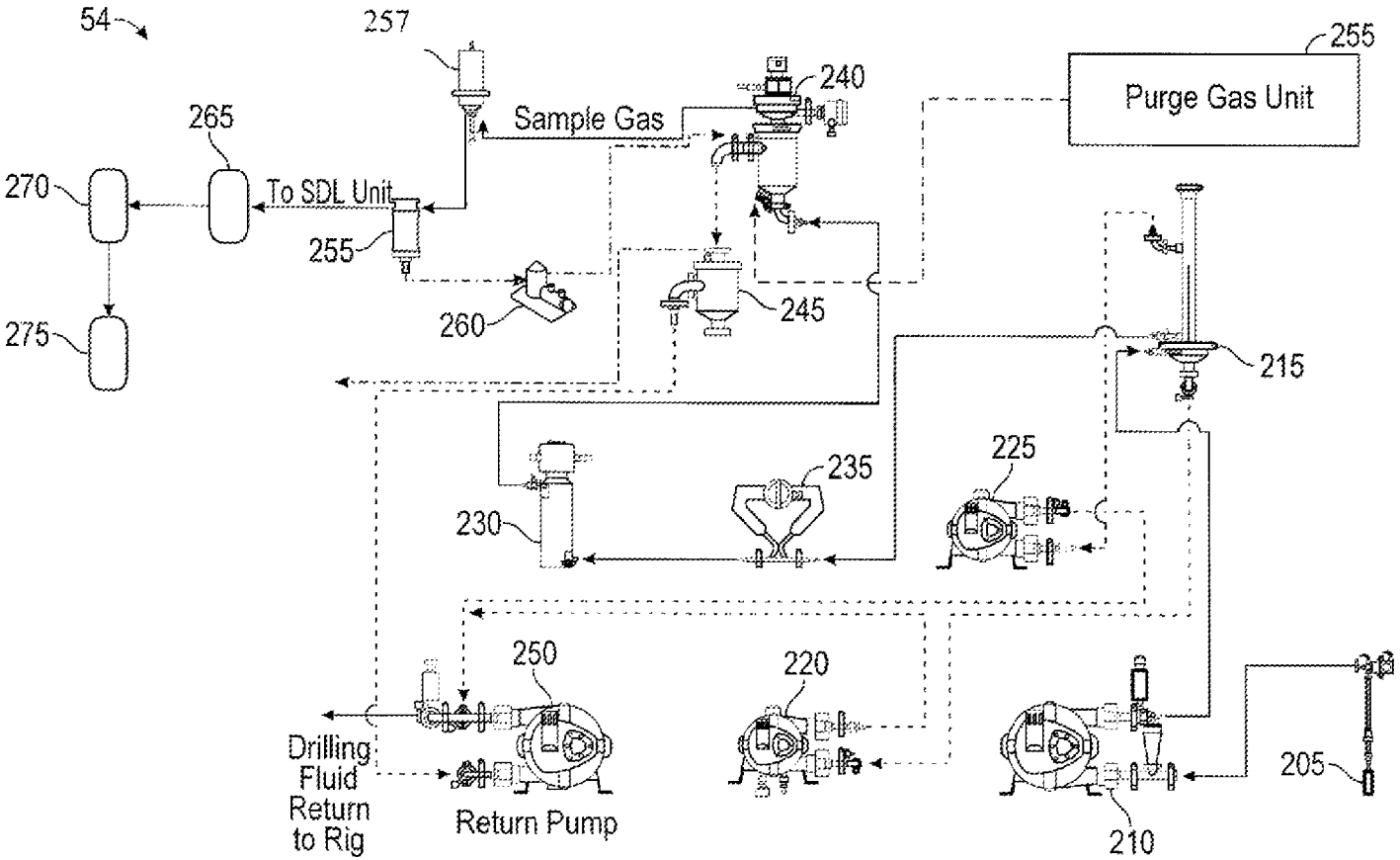
FIG. 2 is a diagram of an example fluid sampling and characterization system.

FIG. 2 shows an example fluid extraction and analysis system 54 for sampling a fluid stream and analyzing extracted fluid. Drilling fluid is received by a drilling fluid probe 205 that is in communication with the drilling fluid system on a drilling rig. In one example embodiment the drilling fluid probe 205 includes a suction tube assembly for receiving drilling fluid. The drilling fluid is drawn into the drilling fluid probe 205, at least in part, by a delivery pump 210. In certain example embodiments the delivery pump 210 is a peristaltic pump. In other example embodiments the deliver pump 210 is a rotary pump. In some example implementations, the delivery pump 210 is controlled to give constant mass or volume of drilling fluid. In some embodiments, a pulse dampener is placed on the output of the delivery pump 210 to reduce or remove pressure waves. The delivery pump 210 delivers the drilling fluid to a separator 215. The separator 215 is to remove solids from the drilling fluid. A solids pump 220 returns the separated solids to the drilling rig. In certain example implementations, a de-aerator pump 225 removes oxygen from the drilling fluid in separator 215. Fluid from the separator 215 is pumped though a temperature change unit 230. In some example embodiments the temperature change unit 230 is a heater to raise the temperature of the drilling fluid. In other example embodiments the temperature change unit 230 is a lowers the temperature of the drilling fluid. In other example embodiments, the temperature change unit 230.

In some example embodiments, the drilling fluid passes through a sensor 235 before entering the temperature change unit 230. Examples of sensor 235 are configured to measure one or more of the mass, volume, and density of the drilling fluid. A degasser 240 is configured to remove a separated fluid from the drilling fluid. The separated fluid may be referred to as a sample. Degasser 240 may be referred to a separator. In some example embodiments, the separation of the sample from the drilling fluid may be performed by the temperature change unit 235 alone or in combination with the external degasser 240. The liquid portion of the drilling fluid is gathered by a liquid trap 245 and fed to a return pump 250, which returns the liquid to the drilling rig. Certain example embodiments use a gravity drain in place of the return pump 250.

In certain example embodiments, a purge gas unit 255 introduces a purge or carrier gas into the drilling fluid from before the drilling fluid reaches the degasser 240. The purge or carrier gas may be used, for example, to increase surface area for fluid extraction or separation. An example purge or carrier gas is nitrogen. In some example embodiments, the separated fluid in a carrier fluid from the degasser 240 undergoes a second separation using a controlled addition or removal of energy. In certain example embodiments, this second separation is to remove or reduce undesirable chemical species, such as water. The remaining fluid that is not part of the sample is returned to the drilling rig fluid system by pump or gravity drain. In one example embodiment, the second separation is performed by vortex cooler 257, condensate separator 255, and condensate pump 260. The same is sent to analyzer 270 for isotopic characterization. Analyzer 270 may be controlled by processor 275, which is an information handling system. Processor 275 may further monitor and control one or more of pumps 210, 220, 250, temperature change unit 230, sensor 235, degasser 240, vortex cooler 257, condensate separator 255, and condensate pump 260. In certain example embodiments processor 275 is local to the drilling rig system 100.

In certain embodiments, a single gas extraction system or dual gas extraction system with a single or multiple analyzers for each or both systems can be used. If a complete dual system is used, the background isotopic concentration can be determined from fluid flowing into the well bore and subtracted from the isotopic concentration determined from the fluid flowing out of the well bore.

Figure 3:
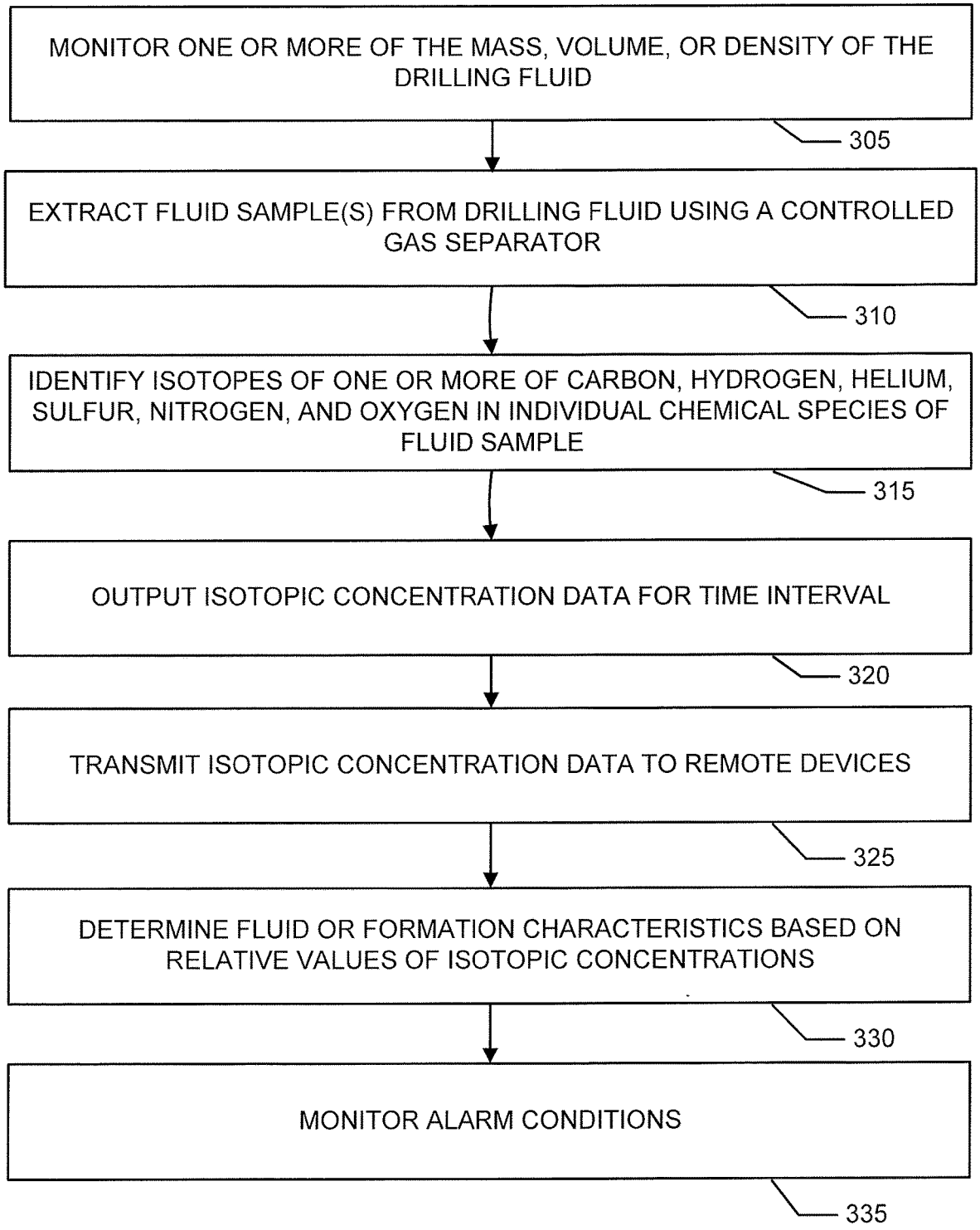
FIG. 3 is a flow chart of an example method for fluid sampling and isotopic characterization.

FIG. 3 is a flow chart of an example method according to the present disclosure. As discussed above, during drilling the system may monitor one or more of the mass, volume or density of the drilling fluid (block 305). The results of the measurement may be received, analyzed, and stored by processor 275. One or more fluid samples are extracting from the drilling fluid, as described above (block 310). The sample is sent to an analyzer 270 for isotopic characterization. In some example embodiments, the sample passes through a manifold 265. In some example embodiments, the analyzer 270 is a gas chromatography-mass spectrometer-infrared device or other device that identifies isotopes of carbon, hydrogen, helium, sulfur, nitrogen, oxygen, or other isotope (block 315). In certain example embodiments the analyzer 270 separates the fluid sample into a plurality of sampled individual chemical species. In one example embodiment, the sampled individual chemical species include C1 (methane), C2 (ethane), C3 (propane), and $CO_2$. For each of these individual chemical species the analyzer 270 identifies isotopes of carbon, hydrogen, helium, sulfur, nitrogen, oxygen, or other isotopes in the individual chemical species.

In one example embodiment, the analyzer 270 determines a concentration of one or both of $^{13}C$ and $^{12}C$ in each of the sampled individual chemical species of C1 (methane), C2 (ethane), C3 (propane), and $CO_2$. In one example embodiment, the analyzer 270 determines a concentration of $^{13}C$ versus a standard in each of the sampled individual chemical species of C1 (methane), C2 (ethane), C3 (propane), and $CO_2$. In other embodiments, the analyzer 270 identifies isotopic concentrations of one or more of carbon, hydrogen, helium, sulfur, nitrogen, oxygen, or other isotopes in one or more of C4 (butane), C5 (pentane), C6 (hexane), benzene, toluene, octane, carbon dioxide, hydrogen sulfide, sulfur dioxide, nitrogen oxide chemical species from the fluid sample.

In some example embodiments, the isotope identification is a specific compound or individual chemical species. In some example embodiments the system performs an identification of isotopes of one or more of carbon, hydrogen, helium, sulfur, nitrogen, and oxygen for one or more hydrocarbons (for example, methane, ethane, or propane) in the sample. In some example embodiments the system further performs an identification of isotopes of one or more of carbon, hydrogen, helium, sulfur, nitrogen, and oxygen for $CO_2$ in the sample. In one example embodiment, processor 275 determines the concentration of $^{13}C$ to $^{12}C$ isotopes in an individual chemical species of a fluid sample relative to the concentration of those isotopes in a standard based, at least in part, on the following equation.

$$\delta^{13}C = \left( \frac{\left(\frac{^{13}C}{^{12}C}\right)_{sample}}{\left(\frac{^{13}C}{^{12}C}\right)_{standard}} - 1 \right) * 1000‰ \quad \text{(Eq. 1)}$$

In other example embodiments the isotope identification is based on a bulk determination of the sample. In some example embodiments, the isotopic concentration is reported as a ratio relative to a standard value. In some example embodiments, the isotopic concentration is reported as a concentration, for example, in parts-per-million (ppm) or as percentage of the overall fluid.

The analyzer 270 produces data in the form of a set of one or more isotopic concentrations on a discrete basis against time (block 320). In certain example embodiments, the analyzer 270 produces data at or around fixed time intervals. Example time intervals are 1 minute, 5 minutes, 10 minutes, 15 minutes. The isotopic concentration data may be output to a user of the system in real time to aid in the drilling process or other operations. As described below, the data may be output in real time along with one or more other well parameters or chemical concentrations. As used herein, "real time" is at or near the time that the analyzer 270 determines the isotopic concentrations. In some example implementations, the time for each discrete analysis is correlated to a depth in the well bore based, at least in part on a pump rate of the drilling fluid, well bore geometry, and dimensions of the drillstring.

In some example implementations, the data from the analyzer 270 is displayed on a display or in a strip log with one or more other well parameters or chemical concentrations. The other well parameters or chemical concentrations include, for example, gas chromatography data, gamma, resistivity, interpreted lithology, neutron, azimuthal lithodensity (ALD), nuclear magnetic resonance (NMR) or other data from down hole tools or surface tools. In some example implementations, the discrete data points are connected by lines. The connecting lines may be mathematically smoothed in some implementations. In some example embodiments, the processor 275 sends isotopic concentration data to remote databases, computers, or other devices on or off rig site (block 325).

In some example embodiments, the processor determines one or more fluid or formation characteristics based, at least in part, on the measured isotopic concentration data for one or more time intervals (block 330). In one example embodiment, the presence of a reservoir is determined by processor 275 based, at least in part, on the concentration of sulfur isotopes versus the concentration of carbon isotopes. In one example embodiment, processor 275 determines the concentration of $^{34}S$ to $^{32}S$ isotopes in an individual chemical species of a fluid sample relative to the concentration of those isotopes in a reference based, at least in part, on the following equation.

$$\delta^{34}S = \left( \frac{(^{34}S/^{32}S)_{sample} - (^{34}S/^{32}S)_{reference}}{(^{34}S/^{32}S)_{reference}} \right) \times 1000 \quad \text{(Eq. 2)}$$

Values of $\delta^{34}S$ isotopes are between −50 to 40. Values of the ratio determined by Eq. 2 are between −100 and 100.

This determination may further be based on one or more additional parameters or chemical concentrations including, for example, gas chromatography data, gamma, resistivity, interpreted lithology, neutron, azimuthal lithodensity (ALD), nuclear magnetic resonance (NMR) or other data from down hole tools or surface tools.

In one example embodiment, the presence of an overly mature system, and the system carriage and type (e.g., terrestrial or marine) are determined by processor 275 based, at least in part, on the concentration of carbon isotopes versus the concentration of nitrogen isotopes. In one example embodiment, processor 275 determines the concentration of $^{15}N$ to $^{14}N$ isotopes in an individual chemical species of a fluid sample relative to the concentration of those isotopes in a reference based, at least in part, on the following equation.

$$\delta^{15}N(‰) = [((^{15}N/^{14}N)_{sample}/(^{15}N/^{14}N_{air}))-1] \times 1000 \quad \text{(Eq. 3)}$$

Values for of $\delta^{15}N$ are between −10 to 30. Values of the resulting ratio calculated by equation 3 are between −100 and 100.

This determination may further be based on one or more additional parameters or chemical concentrations including, for example, gas chromatography data, gamma, resistivity, interpreted lithology, neutron, azimuthal lithodensity (ALD), nuclear magnetic resonance (NMR) or other data from down hole tools or surface tools.

In one example embodiment, the total age of a formation and a maturity of the formation are determined by processor 275 based, at least in part, on the concentration of oxygen isotopes (e.g., one or more of $^{18}O$ and $^{16}O$) versus the concentration of carbon isotopes. This determination may further be based on one or more additional parameters or chemical concentrations including, for example, gas chromatography data, gamma, resistivity, interpreted lithology, neutron, azimuthal lithodensity (ALD), nuclear magnetic resonance (NMR) or other data from down hole tools or surface tools.

In one example embodiment, the total age of a formation and a maturity of the formation are determined by processor 275 based, at least in part, on the concentration of sulfur, oxygen, and nitrogen isotopes in one or more individual chemical species of the fluid sample. This determination may further be based on one or more additional parameters or chemical concentrations including, for example, gas chromatography data, gamma, resistivity, interpreted lithology, neutron, azimuthal lithodensity (ALD), nuclear magnetic resonance (NMR) or other data from down hole tools or surface tools.

In certain embodiments, the processor 275 monitors alarm conditions (block 335). Specific concentrations of isotopes can designated to initiate alarms in real-time or delayed basis to inform parties on or off rig site to indicate a change in isotopic concentration. The specific concentrations can be limits or arbitrary values designated before or during operations that can be in reference to known or estimated isotopic concentrations that are of interest. Alternatively, the isotopic concentrations can related to other parameters through fuzzy logic to produce an alarm for interested parties on or off rig site.

Figure 4:
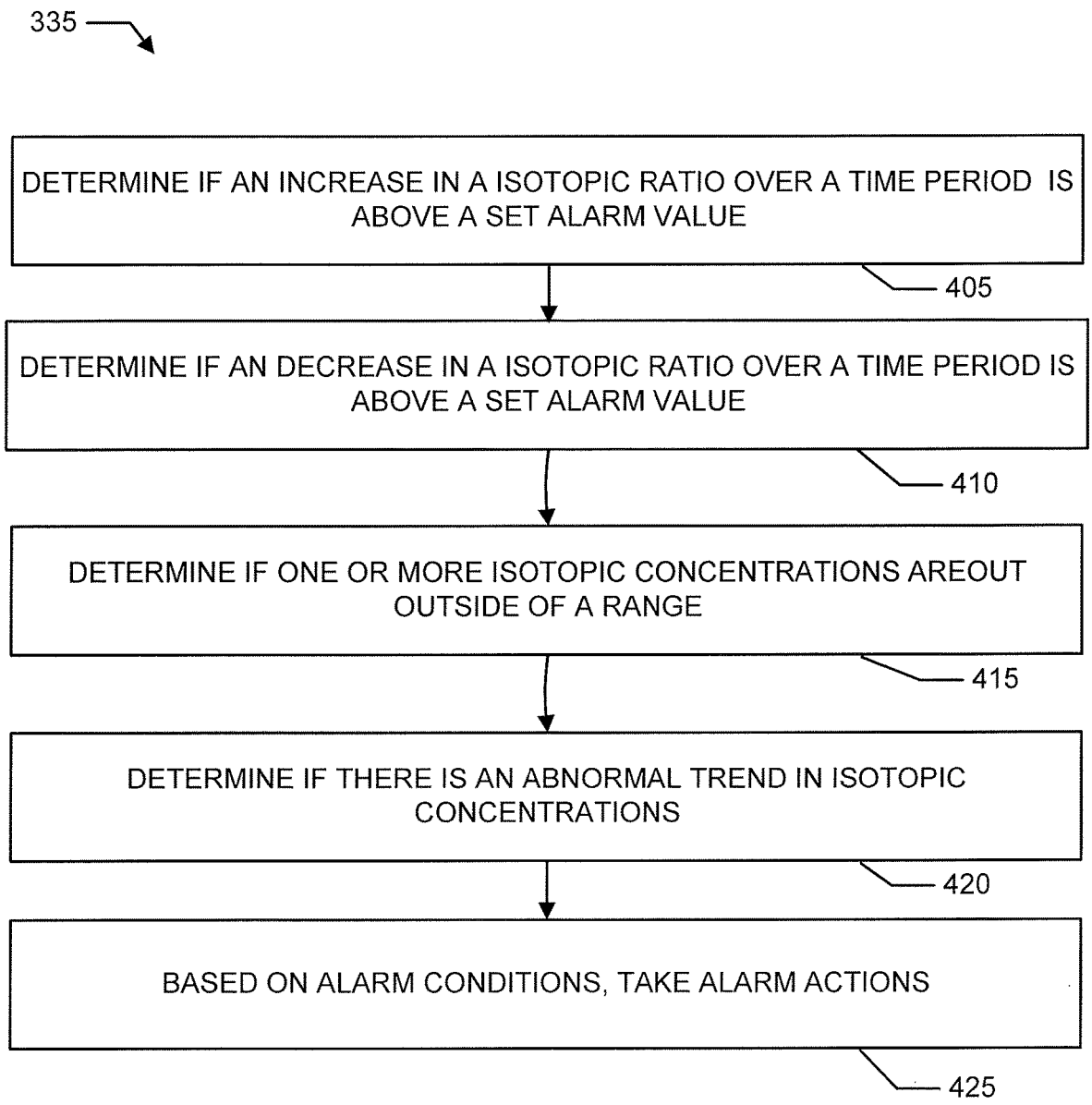
FIG. 4 is a flow chart of an example method of alarm monitoring based on isotopic characterization of fluid samples.

FIG. 4 is a flow chart of an example method of monitoring alarm conditions (block 335). In block 405, the processor 275 determines if an increase in an isotopic ratio over a time period is above a set alarm value. In one example embodiment, the alarm is activated for a 10% or greater change in the isotopic ratio over the period of time. In one example embodiment, the alarm is activated for a 5% or greater change in the isotopic ratio over the period of time. The set alarm value for the change in the isotopic concentration may be specified by a user of processor 275 or it may be determined by processor 275.

In certain example embodiments, the processor 275 determines if a decrease in an isotopic ratio over a time period is above a set alarm value (block 410). In one example embodiment, the alarm is activated for a 10% or greater decrease in the isotopic ratio over the period of time. In one example embodiment, the alarm is activated for a 5% or greater decrease in the isotopic ratio over the period of time. The set alarm value for the change in the isotopic concentration may be specified by a user of processor 275 or it may be determined by processor 275. In certain example embodiments, the processor 275 determines if an absolute isotopic concentration or a ratio of isotopic concentrations are outside of an alarm range of concentrations or ratios of concentrations (block 410). In certain example embodiments, the alarm range is determined based on or more of estimates, customer data, or data from one or more offset wells. The alarm range of concentrations or ratios of concentrations may be specified by a user of processor 275 or they may be determined by processor 275. In certain example embodiments, the processor 275 determines if there is an abnormal trend in isotopic concentrations. For example, when isotopic concentrations of C3 are above C1, the processor 275 may determine that the reservoir is degraded. In certain example embodiments where the ration of C3/C1 is at or near 1, the processor 275 may determine a lack of methane production due to reservoir or fluid being highly degraded or missing a gas phase.

If one or more of the alarm conditions of blocks 405, 410, 415, or 420 are met, the processor 275 takes on or more alarm actions (block 425). Example alarm actions include a providing a visual or audible alert to one or more users. Other example alarm actions include sending a message to one or more users by email, SMS/MMS text messaging, pager, or other messaging methods.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are each defined herein to mean one or more than one of the element that it introduces.

What is claimed is:

1. A method for downhole formation evaluation, comprising:

extracting a fluid sample from a drilling fluid using a degasser, wherein the drilling fluid passes through a separator, a sensor, and a temperature change unit prior to entering the degasser, wherein the separator is configured to remove solids from the drilling fluid, wherein the separator is fluidly coupled to the sensor, wherein the sensor is fluidly coupled to the temperature change unit, wherein the temperature change unit is fluidly coupled to the degasser;

performing a second separation on the fluid sample from the drilling fluid after extracting the fluid sample within the degasser, wherein the second separation is performed by a vortex cooler, a condensate separator, and a condensate pump, wherein the second separation further removes or reduces undesirable chemical species;

extracting a plurality of individual chemical species from the fluid sample, wherein the individual chemical species include methane, ethane, propane, and $CO_2$;

identifying one or more concentrations of one or more isotopes in each of the individual chemical species using a gas chromatography-mass spectrometer-infrared device relative to a concentration of at least one of the one or more isotopes in a standard, including identifying concentrations of a carbon isotope in each of the individual chemical species; and outputting the one or more concentrations in each of the individual chemical species for a first time period.

2. The method of claim 1, wherein outputting the one or more concentrations in each of the individual chemical species for the time period comprises:

displaying the one or more concentrations to a user in real time.

3. The method of claim 1, wherein identifying the one or more concentrations further comprises:

identifying at least one of, hydrogen, helium, sulfur, nitrogen, and oxygen isotope concentrations in one or more of the individual chemical species.

4. The method of claim 1, further comprising:

determining a corresponding wellbore depth for the one or more concentrations for the first time period; and wherein determining a formation characteristic of a formation being drilled is further based, at least in part, on the corresponding wellbore depth.

5. The method of claim 1, further comprising:

at a second time, extracting a second plurality of individual chemical species from the fluid sample, wherein the individual chemical species include methane, ethane, propane, and $CO_2$;

identifying a second one or more concentrations for a second one or more isotopes for the second time in each of the individual chemical species;

outputting the second one or more concentrations for the second time period; and determining whether an alarm condition is met, based, at least in part, on the second one or more concentrations for the second time.

6. The method of claim 1, further comprising determining whether an alarm condition is met, based, at least in part, on the one or more concentrations for the first time period, wherein the alarm condition is a 5% or greater change in an isotopic ratio over the first time period.

7. The method of claim 1, further comprising:

determining a formation characteristic of a formation being drilled, based, at least in part, on the one or more concentrations, wherein the formation characteristic includes one or more of a formation age, a formation maturity, a system carriage, and a system type.

8. The method of claim 7, further comprising:

monitoring one or more of the mass, volume, and density of the drilling fluid for the first time period; and wherein determining a formation characteristic of the formation being drilled, is further based, at least in part, on the mass, volume, and density of the drilling fluid for the first time period.

9. The method of claim 1, wherein identifying the one or more concentrations further comprises:

identifying carbon isotope concentrations of in each of the individual chemical species.

10. The method of claim 9, further comprising:

determining whether an alarm condition is met, based, at least in part, on the one or more concentrations for the first time period and a second one or more concentrations for the second time period.

11. A system for downhole formation evaluation, comprising:

a separator, wherein the separator is configured to remove solids from a drilling fluid;

a de-aerator pump, wherein the de-aerator pump is configured to remove oxygen from the drilling fluid within the separator, wherein the de-aerator pump is fluidly coupled to the separator;

a sensor, wherein the sensor is configured to measure one or more of the mass, volume, and density of the drilling fluid, wherein the sensor is fluidly coupled to the separator;

a temperature change unit, wherein the temperature change unit is fluidly coupled to the sensor, wherein the sensor is disposed between the temperature change unit and the separator;

a degasser to extract a fluid sample from the drilling fluid, wherein the degasser is fluidly coupled to the temperature change unit, wherein the drilling fluid passes through the separator, the sensor, and the temperature change unit prior to entering the degasser;

a vortex cooler configured to further remove or reduce undesirable chemical species in the fluid sample, wherein the vortex cooler is fluidly coupled to the degasser, wherein the fluid sample passes through the vortex cooler after leaving the degasser;

an isotopic fluid analyzer including a gas chromatography-mass spectrometer-infrared device to identify a first one or more concentrations of a hydrogen isotope and a second one or more concentrations of a carbon isotope in individual chemical species in the drilling fluid, wherein the individual chemical species include methane, ethane, propane, and $CO_2$;

wherein the isotopic fluid analyzer is further to output the first one or more concentrations and the second one or more concentrations for a first time period; and at least one processor and a memory, the memory including non-transitory executable instructions that, when executed by the processor, cause the at least one processor to:

receive the first one or more concentrations and the second one or more concentrations for the first time period from the isotropic fluid analyzer; and output the first one or more concentrations and the second one or more concentrations to a user in real time.

12. The system of claim 11, wherein the executable instructions further cause the at least one processor to:

determine a formation characteristic of a formation being drilled, based, at least in part, on the first one or more concentrations and the second one or more concentrations, wherein the formation characteristic includes one or more of a formation age, a formation maturity, a system carriage, and a system type.

13. The system of claim 11, wherein the isotopic fluid analyzer is further to identify a concentration of at least one of a helium isotope, a sulfur isotope, and a nitrogen isotope in one or more of the individual chemical species.

14. The system of claim 11, wherein the executable instructions further cause the at least one processor to determine whether an alarm condition is met, based, at least in part, on the first one or more concentrations and the second one or more concentrations for the first time period, wherein the alarm condition is a 5% or greater change in an isotopic ratio over the first time period.

* * * * *